United States Patent [19]

Groothuis et al.

[11] Patent Number: 5,014,251

[45] Date of Patent: May 7, 1991

[54] DEVICE PRODUCING STOPPING OF A MOVABLE ELEMENT IN A DETERMINED POSITION AND A TIMEPIECE HAVING A COUNTING INDICATOR OF A FINITE DURATION

[75] Inventors: Michiel Groothuis, Saint-Imier; Francois Nikles, Cressier, both of Netherlands

[73] Assignee: Conseilray S.A., Switzerland

[21] Appl. No.: 487,582

[22] Filed: Mar. 2, 1990

[30] Foreign Application Priority Data

Mar. 7, 1989 [CH] Switzerland ..... 831/89

[51] Int. Cl.[5] ..... G04B 19/04; G04F 8/00

[52] U.S. Cl. ..... 368/80; 368/108; 368/233

[58] Field of Search ..... 368/76, 80, 157, 160, 368/107-113, 233

[56] References Cited

U.S. PATENT DOCUMENTS 3,910,362 10/1975 Piguet ..... 368/104
4,238,847 12/1980 Daly ..... 368/89
4,623,261 11/1986 Muto ..... 368/80
4,866,684 9/1989 Besson ..... 368/108

*Primary Examiner*—Vit W. Miska
*Attorney, Agent, or Firm*—Silverman, Cass & Singer, Ltd.

[57] ABSTRACT

The motor driving a minute-indicator in a down counting operation which must count a finite duration is stopped when the terminal post of its control circuit is connected to "earth" potential by an electric line. A seconds-hand, rotating in synchronism with a minute-indicator, effects several revolutions during the counting operation. It is rigid with an elastic arm which, at each revolution, slides on a part of the circuit, connecting the latter to earth. This produces however stopping of the motor only at the last revolution of the seconds-hand, when a contact switch mounted in series with the sliding switch is also closed under the action of a control pin acting on an elastic blade. This pin is carried by a manually operable rocking lever which is provided with a toothed sector meshing with a pinion rigid with the minute-indicator. When the rocking lever is operated, the motor is started due to the opening of the contact and, simultaneously, the minute-indicator is brought into its starting position for counting.

9 Claims, 3 Drawing Sheets

DEVICE PRODUCING STOPPING OF A MOVABLE ELEMENT IN A DETERMINED POSITION AND A TIMEPIECE HAVING A COUNTING INDICATOR OF A FINITE DURATION

BACKGROUND OF THE INVENTION (a) Field of the Invention

The present invention relates to a device to effect stopping, in a determined position, of a movable element driven by an electric motor and which has to be able to run at least once past its stopping position without stopping thereat.

The invention also relates to a timepiece having a rotatable counting indicator of a finite duration driven by an electric motor which has to stop at the end of a counting operation.

(b) Description of the Prior Art

The stopping, in a determined position, of a movable element driven by an electric motor does not give rise to problems when the stopping has to occur at each passage of the movable element at said position. As a matter of fact, it is sufficient, in this case, to provide the movable element with a control device of an electric switch provided in the energising circuit of the motor in such a way that, at the passage of the movable element at the position where the stopping must occur, it opens said switch, which stops the motor and produces the desired stopping of the movable element driven by this motor.

If, on the contrary, the movable element has without stopping to run past, one or more times, the position at which the stopping must finally occur, the problem is more difficult.

SUMMARY OF THE INVENTION

An object of the present invention is precisely to furnish a solution to the foregoing problem.

This object is achieved by the fact that the electric motor is driven by a circuit comprising a terminal post which, when put to a determined polarity, produces the stopping of this motor; that the movable element closes, at each of its passages at said position, a first switch mounted in a line connecting said terminal post of the circuit of the motor to said polarity; and that said movable element is desmodromically connected, but with demultiplication, to a movable member controlling a second switch mounted in series with said first switch in said line, the whole being arranged in such manner that said movable member occupies the position in which it closes said second switch at the moment the movable element reaches the position of the end of its running, the simultaneous closing of the two switches resulting in stopping of the motor and, consequently, stopping of the movable element.

The stopping of a movable element in a determined position past which it must previously run one or more times without stopping is a problem which appears in the time counters intended to effect counting of a finite duration, in the mathematical sense of the term, which comprise two indicators one of which indicates the time in one unit of time and the other one in another unit of time which is a submultiple of the first one, and in which this last indicator, which is rotatable, must be able to make more than one revolution during the time the first indicator effects its complete running of one revolution at the most.

Another object of the present invention is to furnish a solution to this problem.

This object is achieved by the fact that, in a timepiece in accordance with the invention, the motor is controlled by a circuit comprising a terminal post which, when put to a determined polarity, produces stopping of the motor; that said indicator, when in its position of end of running, over which it has to pass at least once without stopping, closes a first switch mounted in a line connecting said terminal post of the circuit to said polarity; and that said indicator is desmodromically connected, but with demultiplication, to a movable member operating a second switch mounted in series with said first switch on said line, the whole being arranged in such manner that said movable member occupies a position in which it closes said second switch at the moment when the indicator reaches the position of its end of running, the simultaneous closing of the two switches resulting in stopping of the motor and, consequently, stopping of the indicating member.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
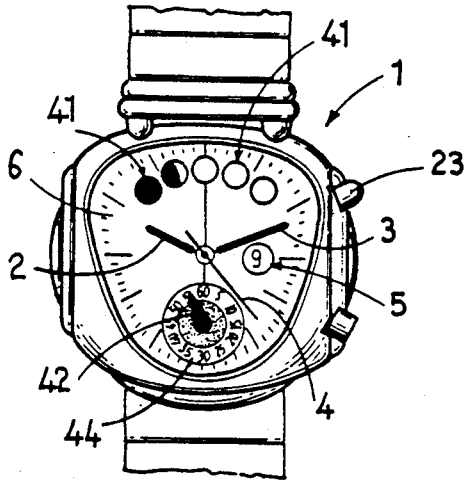
FIG. 1 is a plan view of a sports wrist-watch having a counter permitting the counting of a finite duration.
Figure 2:
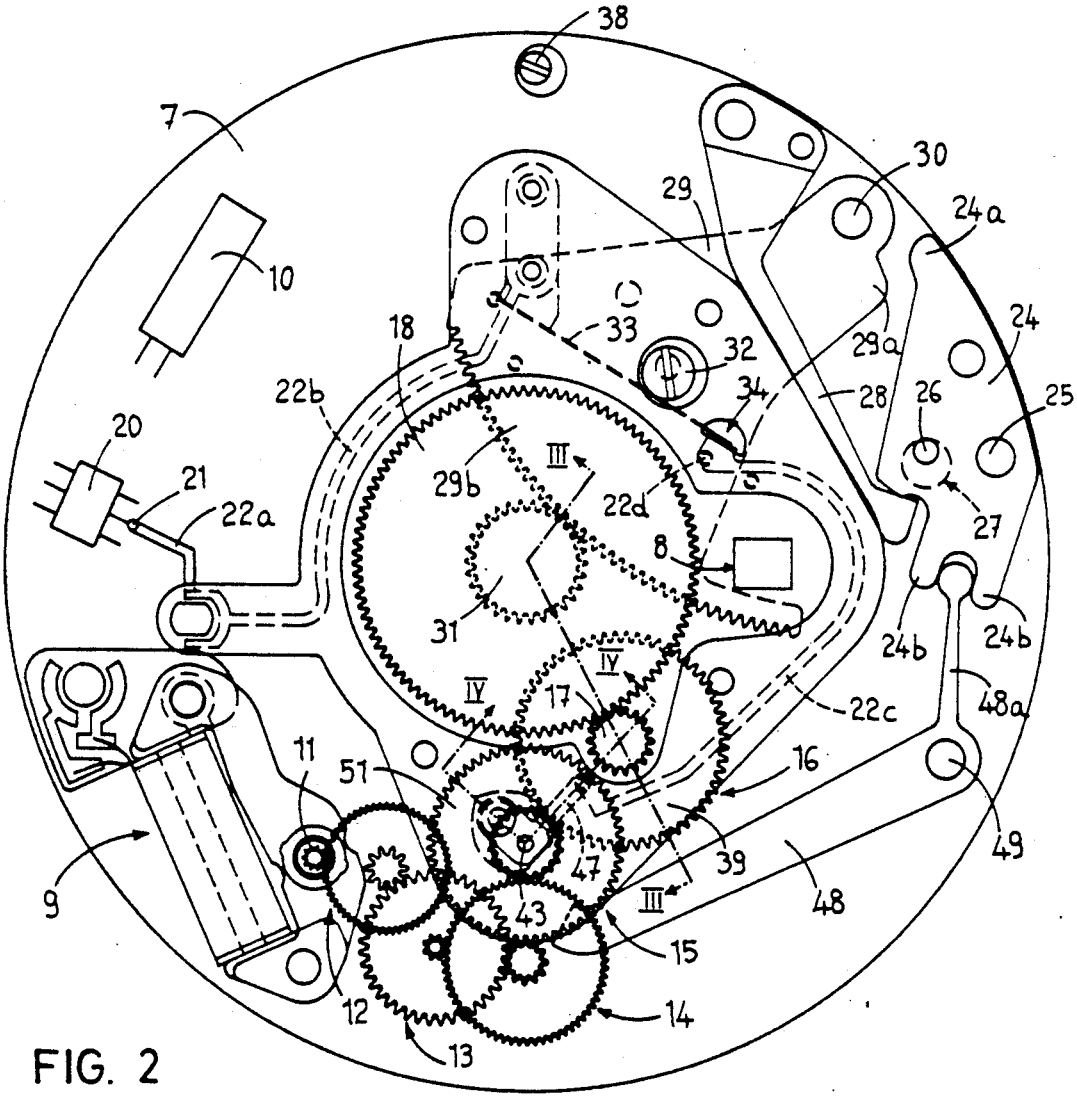
FIG. 2 is a plan view, to a larger scale, of a part of the mechanism of this watch in its rest position.

The sports wrist-watch illustrated in FIG. 1, generally designated by the reference 1, is intended to enable yachtsmen to check the time which remains available before the signal for starting of a regatta is given. The watch comprises a conventional electronic movement, which has not been illustrated since it is known per se, having a quartz oscillator, driving three conventional hands, an hour-hand, a minute-hand and a seconds-hand, designated by the references 2, 3 and 4, respectively.

This watch comprises moreover a date indicator which appears in a window 5 provided in the watch dial designated by the reference 6.

Figure 5:
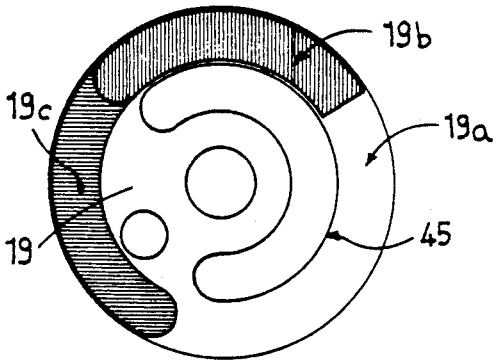
FIG. 5 is a plan view of a detail.

Beside the usual movement driving the hands indicating the running time, the watch illustrated comprises an independent counting module, superposed on the conventional movement, on the dial side thereof. The frame of this module comprises a base-plate 7 provided with an opening 8 situated opposite the window 5 of the dial 6. This base-plate 7 carries an electric motor, generally designated by the reference 9, controlled by a quartz oscillator diagramatically represented at 10, the rotor of which carries a pinion 11 constituting the first element of a gearing comprising movable elements 12, 13, 14, 15 and 16; the pinion of this last movable element, designated by the reference 17, meshes with a wheel 18 situated at the center of the movement. This wheel 18 carries a minute-indicator constituted by a disc 19 presenting three areas of different colours 19*a*, 19*b* and 19*c* (FIG. 5) each having the shape of a segment of crown.

The controlling circuit of the motor 9, diagramatically represented at 20, comprises a terminal post 21 connected to a conductive track 22*a* to 22*e* insulated from the main body of the movement hereinafter considered to be at circuit "earth" potential, this conductive track serving to control the motor 9. The terminal point 22*e* of this conductive track can be connected to earth potential by means which will be indicated later; the circuit 20 is such that, when the terminal post 21 is connected to the earth potential, the motor is stopped, which is known per se.

The watch comprises a pushbutton 23 (FIG. 1) for manual operation of a rocking lever 24 pivotally mounted at 25 on the base-plate 7 and which carries a pin 26 passing through an opening 27 in the base-plate, which limits the movement of the rocking lever. The latter is returned by a spring 28.

The rocking lever 24 is provided with a nose 24*a* co-operating with a nose 29*a* of a rocking lever 29 pivotally mounted at 30 on the base-plate 7. The rocking lever 29 is provided with a toothed sector 29*b*, constituting a rack, meshing with a pinion 31 rigid with the wheel 18 carrying the minute-indicator 19. The rocking lever 29 carries moreover an adjustable abutting member 32 which is eccentrically mounted, intended to act on an elastic blade 33 to bring it into contact, at 34, with the end, designated by the reference 22*d*, of the conductive track 22*c* and thus connecting it to the earth potential of the body of the watch 1.

Figure 6:
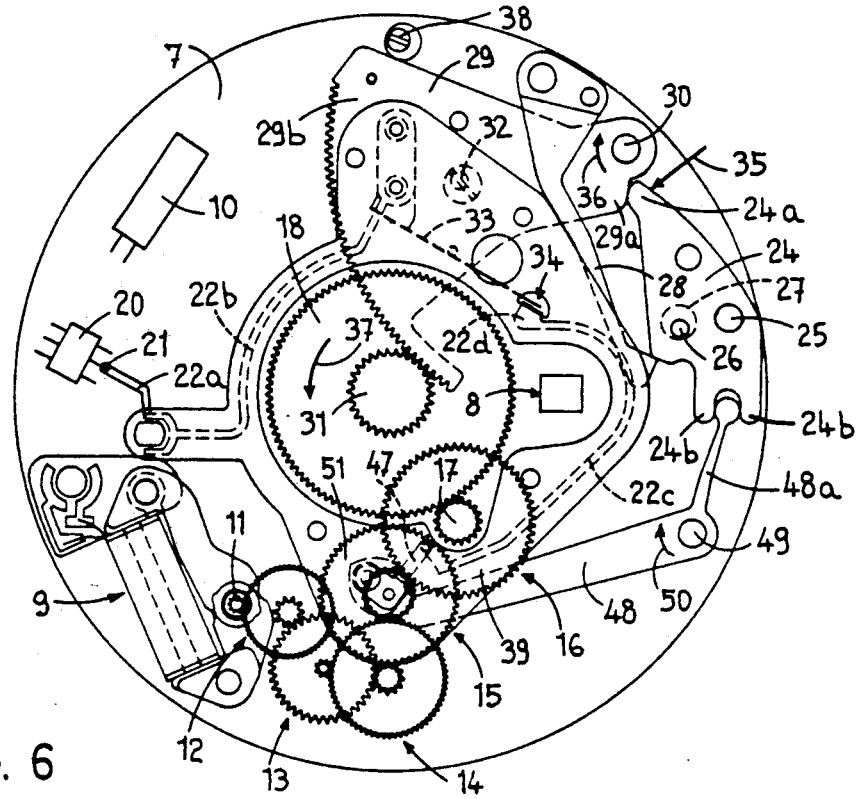
FIG. 6 is a plan view of the mechanism, corresponding to this of FIG. 2, to a smaller scale, in which this mechanism is represented in its starting position.

When a pressure is exerted on the pushbutton 23, as indicated by the arrow 35 of FIG. 6, the rocking lever 24 produces a rotation of the rocking lever 29 in the direction of the arrow 36 that, owing to the meshing of the rack 29*b* with the pinion 31, produces the rotation of this pinion and consequently of the indicator 19, in the direction of the arrow 37, that is to say in the counter-clockwise direction, until it abuts against an adjustable stop pin 38 mounted on an eccentric, carried by the base-plate 7; simultaneously, the pin 32 releases the blade 33, which itself releases the portion 22*d* of the conductive track, which starts the motor 9 since the terminal post 21 of its control circuit 20 is this way no more at the earth potential.

Figure 3:
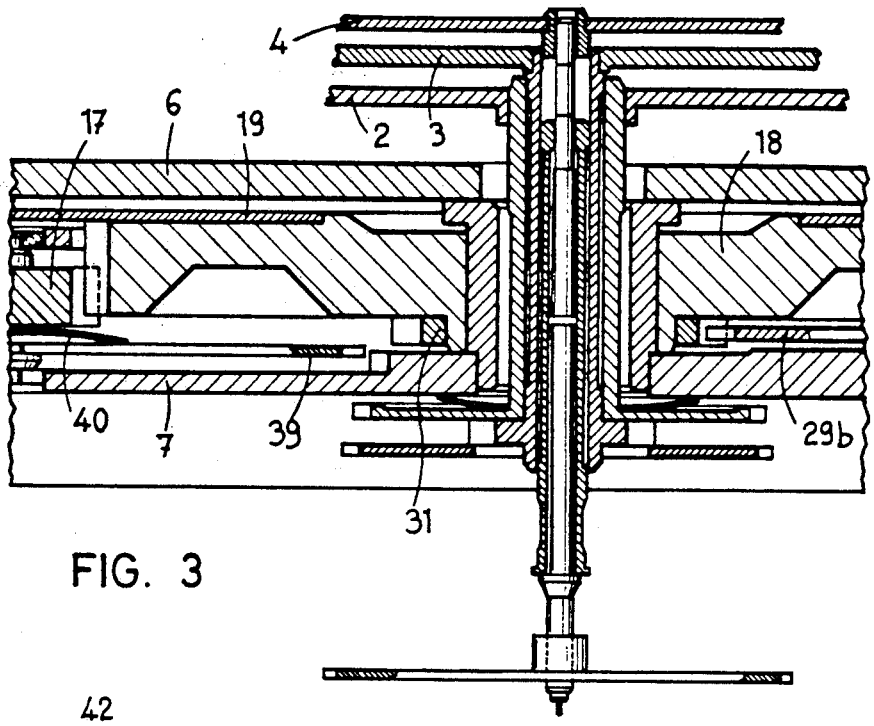
FIG. 3 is a sectional view on the line III—III of FIG. 2 to a larger scale.
Figure 4:
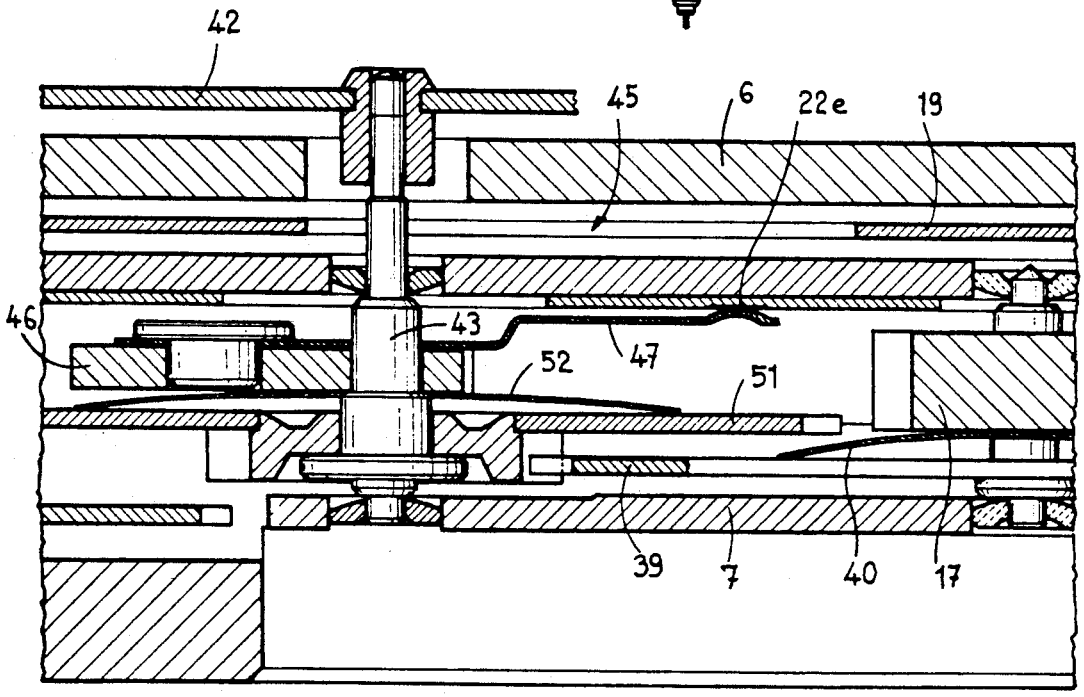
FIG. 4 is a sectional view on the line IV—IV of FIG. 2 to still a larger scale.

It is to be noted that the two elements—pinion 17 and wheel, designated by the reference 39—of the movable element 16 of the gearing connecting the motor 9 to the indicator 19 are connected to each other by a friction device comprising a cambered washer 40 (FIGS. 3 and 4) so that on the one hand the rack 29*b* can be operated without the gearing turning the motor 9 and on the other hand the motor can start as soon as the electrical contact at 34 is open even should a pressure still be exerted on the pushbutton 23 so that, consequently, the pinion 31 would be blocked by the rack 29*b*.

The three areas of different colours 19*a*, 19*b* and 19*c* of the disc 19 appear successively in five windows 41 (FIG. 1) provided in the dial 6. The user of the watch accordingly sees the three areas of different colours of the indicator 19 passing opposite these five windows, which gives him a notion of the time which remains available before the indicator 19 will have returned to its initial position. In the special case of the watch intended to be used at the start of a regatta, the total duration of displacement of the indicator 19 will be of ten minutes.

So that the indications given to the user of the present watch can be more precise the watch comprises a seconds-hand 42 mounted on the shaft, designated by reference 43 (FIG. 4), of the movable element 15 of the gearing connecting the motor 4 to the indicator 19. This seconds-hand makes one revolution per minute, so that it is intended to make ten revolutions during the ten minutes of the running of the disc 19; it rotates opposite a seconds-circle 44 provided on the dial 6 of the watch (FIG. 1).

It is to be noted that the indicating disc 19, which effects only oscillatory rotative movements, is provided with a circular arc shaped aperture 45 (FIG. 5) through which the shaft 43 of the seconds-hand 42 passes.

The shaft 43 carrying the seconds-hand 42 carries, driven thereon, a reset heart 46 (FIG. 4) on which is secured a conductive elastic blade 47 which is thus at the body potential of the movement and comes in contact, once per revolution, with the terminal post 22*e* ending the conductive track 22*a* to 22*c* connected to the terminal post 21 of the circuit 20 controlling the motor 9. Once per revolution of the hand 42, the arm 47 comes into contact with the terminal post 22*e* and, in this manner, connects the terminal post 21 to earth, provided the contact 34, mounted in series with the contact 47–22*e*, is closed. However, since, up to the last revolution of the hand 42 this contact 34 operated by the pin 32 of the rocking lever 29 is open, this connecting to earth of the terminal post 21 is not effectively produced so that the motor 9 continues to rotate. It is only at the end of the last revolution of the hand 42 that, at the moment when this hand is situated opposite the data 60 of the seconds-circle 44 and when the arm 47 comes into contact with the terminal post 22*e*, simultaneously the pin 32 closes the switch 34. The terminal post 21 of the circuit 20 is then connected to earth and the motor stops, the minute-indicator 19 being then at the end of its running, and the seconds-hand 42 being situated opposite the datum 60 of the seconds-circle 44.

Figure 7:
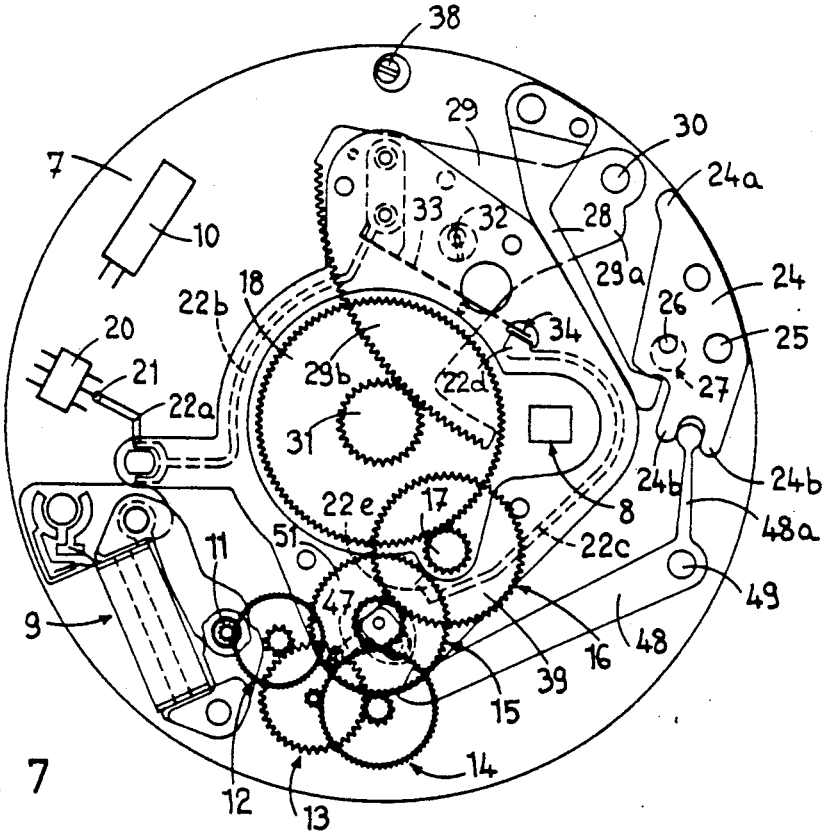
FIG. 7 is a similar plan view, the mechanism being represented during its operation.

Since the pushbutton 23 can be operated even whilst the down counting is being effected, that is to say even when the motor 9 is running, and since the hand 44 occupies any position opposite the seconds-circle 44 (FIG. 7), a hammer 48 is provided which produces the resetting to zero of this hand, this hammer 48, articulated at 49 on the base-plate 7, is provided with an arm 48*a* the end of which is engaged between the branches 24*b* of a fork-shaped portion of the rocking lever 24. Operation of this rocking lever 24 by means of the pushbutton 23 urges the hammer 48 to rotate in the direction of the arrow 50 (FIG. 6), which causes the hammer to co-operate with the return-to-zero heart 46 thus bringing the hand 42 back opposite the datum 60 of the seconds-circle 44. Hence, even if the control mechanism is operated manually during counting, the hand 42 still occupies its correct initial position at the commencement of a new count, when the pressure on the pushbutton 23 is released.

It is to be noted that the connection between the shaft 43 carrying the hand 42 and the wheel, designated by the reference 51 (FIG. 4), of the movable element 15 is a friction connection, provided by a cambered washer 52, so that resetting to zero of the hand 42 can be effected without driving the gearing connecting the motor 9 to the indicator 19.

The timepiece disclosed and illustrated and conceived specifically in view of the starting of regatta, is only one example of the application of the invention. The invention can be applied to other counters, for instance a count of 45 minutes for use at football matches or of still longer duration, for use in undersea diving especially.

The element indicating a submultiple of the main indicator, here the hand 42, could be an indicator other than a seconds-indicator and could indicate fractions of seconds or any other units of time.

We claim:

1. A device for stopping a movable element in a determined position comprising:

an electric motor;

a movable element driven by said electric motor and which has to be able to run at least once past a stopping position without stopping thereat;

a circuit for driving said motor including a terminal post which, when put to a determined polarity, produces the stopping of said motor;

a first switch mounted along a path and connecting said terminal post of said circuit to said polarity in which said movable element closed, at each of its passages at said position, said first switch;

a second switch mounted in series with said first switch in said path; and a movable member positively connected through gearing to said movable element and controlling said second switch mounted in series with said first switch in said path, so that said movable member occupies the position in which it closes said second switch at the moment the movable element reaches the position of the end of its running, the simultaneous closing of the two switches resulting in stopping of the motor and, consequently, stopping of the movable element.

2. A device according to claim 1, in which the movable member operating the second switch belongs to a manually operable control mechanism operative to start the electric motor.

3. A timepiece comprising:

an electric motor;

a rotatable counting indicator of a finite duration driven by said electric motor stopping at the end of the counting;

a circuit for controlling said motor including a terminal post which, when put to a determined polarity, produces stopping of the motor;

a first switch mounted along a path and connecting said terminal post of said circuit to said polarity in which said indicator, when in its position of end of running, over which it has to pass at least once without stopping, closes said first switch;

a second switch mounted in series with said first switch in said path; and a movable member positively connected through gearing to said indicator and operating said second switch mounted in series with said first switch in said path, so that said movable member occupies a position in which it closes said second switch at the moment when the indicator reaches the position of its end of running, the simultaneous closing of the two switches resulting in stopping of the motor and, consequently, stopping of the indicator.

4. A timepiece according to claim 3, in which the movable member operating the second switch belongs to a manually operated mechanism operative to start the motor.

5. A timepiece according to claim 3, which comprises a second indicator, driven by said motor and rotating at a speed which is lower than that of the first-mentioned indicator, said second indicator effecting only a fraction of a revolution during the complete running of more than one revolution of the first indicator.

6. A timepiece according to claim 5, comprising a gearing connecting said second indicator to the motor, said gearing including intermediary movable elements, in which one of said intermediary movable elements drives the first indicator.

7. A timepiece according to claim 5, in which the manually operable control movable member is constituted by a rocking lever provided with a toothed sector meshing at least indirectly with one of the movable elements of said gearing.

8. A timepiece according to claim 6, in which one of the movable elements of said gearing has its two elements—wheel and pinion—connected to each other by a friction device having the effect that, at the starting of the motor by means of the control movable member, the motor is not positively urged by the gearing.

9. A timepiece according to claim 4, in which said indicator is rigid with a resetting heart and is driven through the intermediary of a friction device, the manually operable control mechanism comprising a reset-to-zero heart operated at the same time as the movable control member, which brings the indicator, when the control mechanism is operated even when the motor is already running, back into an initial starting position which is the same as its position at the end of its running.

* * * * *